United States Patent [19]

Chin-Sen

[11] Patent Number: 4,606,540

[45] Date of Patent: Aug. 19, 1986

[54] SINGLE COLUMN GYM SET

[76] Inventor: Chiu Chin-Sen, No. 200, Jen Hsin Road, Jen Wu Hsiang, Kaohsiung Hsien, Taiwan

[21] Appl. No.: 640,812

[22] Filed: Aug. 15, 1984

[51] Int. Cl.[4] ..... A63B 21/06

[52] U.S. Cl. ..... 272/118; 272/117; 272/134

[58] Field of Search ..... 272/118, 134, 117, 136, 272/123, 93, 132, 143

[56] References Cited

U.S. PATENT DOCUMENTS

| | | | |
|---|---|---|---|
| 3,635,472 | 1/1972 | Marcyan | 272/118 |
| 3,807,728 | 4/1974 | Chillier | 272/118 |
| 3,840,227 | 10/1974 | Chesemore | 272/118 |
| 4,256,302 | 3/1981 | Keiser et al. | 272/118 |
| 4,339,125 | 7/1982 | Oyeda et al. | 272/118 |
| 4,346,888 | 8/1982 | Szabo | 272/118 |
| 4,357,011 | 11/1982 | Voris | 272/118 |
| 4,470,596 | 9/1984 | Desiderio | 272/118 |
| 4,505,475 | 3/1985 | Olschansky et al. | 272/118 |

*Primary Examiner*—Richard J. Apley
*Assistant Examiner*—J. Welsh
*Attorney, Agent, or Firm*—Kirschstein, Kirschstein, Ottinger & Israel

[57] ABSTRACT

A gym set includes a single column bounding an interior channel and having a rear opening extending along a rear wall of the column. A vertically-arranged stack of weight blocks is movable by an exerciser along the column. Each weight block has an interior block portion located within the channel, an exterior block portion located outside the channel, and an intermediate block portion extending through the rear opening. The blocks are reliably guided throughout their movement along the column.

19 Claims, 19 Drawing Figures

SINGLE COLUMN GYM SET

BACKGROUND OF THE INVENTION

1. Field of the Invention

This invention generally relates to multi-functional gym sets and, more particularly, to gym sets that are safe to use.

2. Description of the Related Art

Nowadays, all the multi-purpose gym sets on the market have vertically-movable weight blocks placed at the front of them, and this structure often causes the exerciser to be injured during exercise because no device separates him from the weight blocks. Such an injury may sometimes be attributed to his own carelessness, but it is never impossible for a gym set to be made with safety features which avoid the abovementioned defect—in other words, the gym set can be faulted for the lack of safety. As all weight blocks are made of heavy metal, the exerciser would become unable to continue his training owing to the pain once he should be hit by the moving weight blocks. It is quite easy to imagine that a plurality of said metal blocks can give a serious injury—even a broken bone or a concussion or worse—to the exerciser as they are moving up and down. Therefore, a kind of safe construction is indispensable in an exercise equipment, such as a gym set, and at the same time it be economical. In order to meet the above-mentioned requirements, the inventor has worked out this safe and multifunction gym set.

SUMMARY OF THE INVENTION

Accordingly, one feature of this invention resides, briefly stated, in a gym set comprising a base mountable on a support surface, such as the floor, and an upright column supported by the base. The column has a planar front wall, a pair of planar side walls extending rearwardly and perpendicularly of the front wall, and a pair of planar rear walls extending toward each other in a plane generally parallel to, and spaced from, the front wall. The rear walls terminate short of each other to bound a rear opening which extends lengthwise along the column. The front, side and rear walls bound an interior channel.

The gym set also comprises a weight bed reciprocally movable lengthwise along the column. The bed includes a vertically-arranged stack of weight blocks, and means for selecting, at the option of an exerciser, the number of weight blocks which will participate in the reciprocal movement of the bed. Each block has a pair of cutouts in which the rear walls extend. Each block further has an interior block portion located within the channel, an exterior block portion located outside the channel, and an intermediate block portion between the interior and exterior block portions and extending through the rear opening. The blocks are located rearwardly of the front wall, and are reliably guided along the column throughout the reciprocal movement. The exerciser engages user-engaging means, e.g. a handgrip, a training bar assembly, a workout bench, in order to reciprocally move the weight bed along the column. These features assure that the weight blocks will not swing uncontrollably during exercising and possibly injure the exerciser.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE INVENTION

Figures 1, 5A, 5B, 5C, 5D, 5E, 6A, 6B, 6C, 6D:
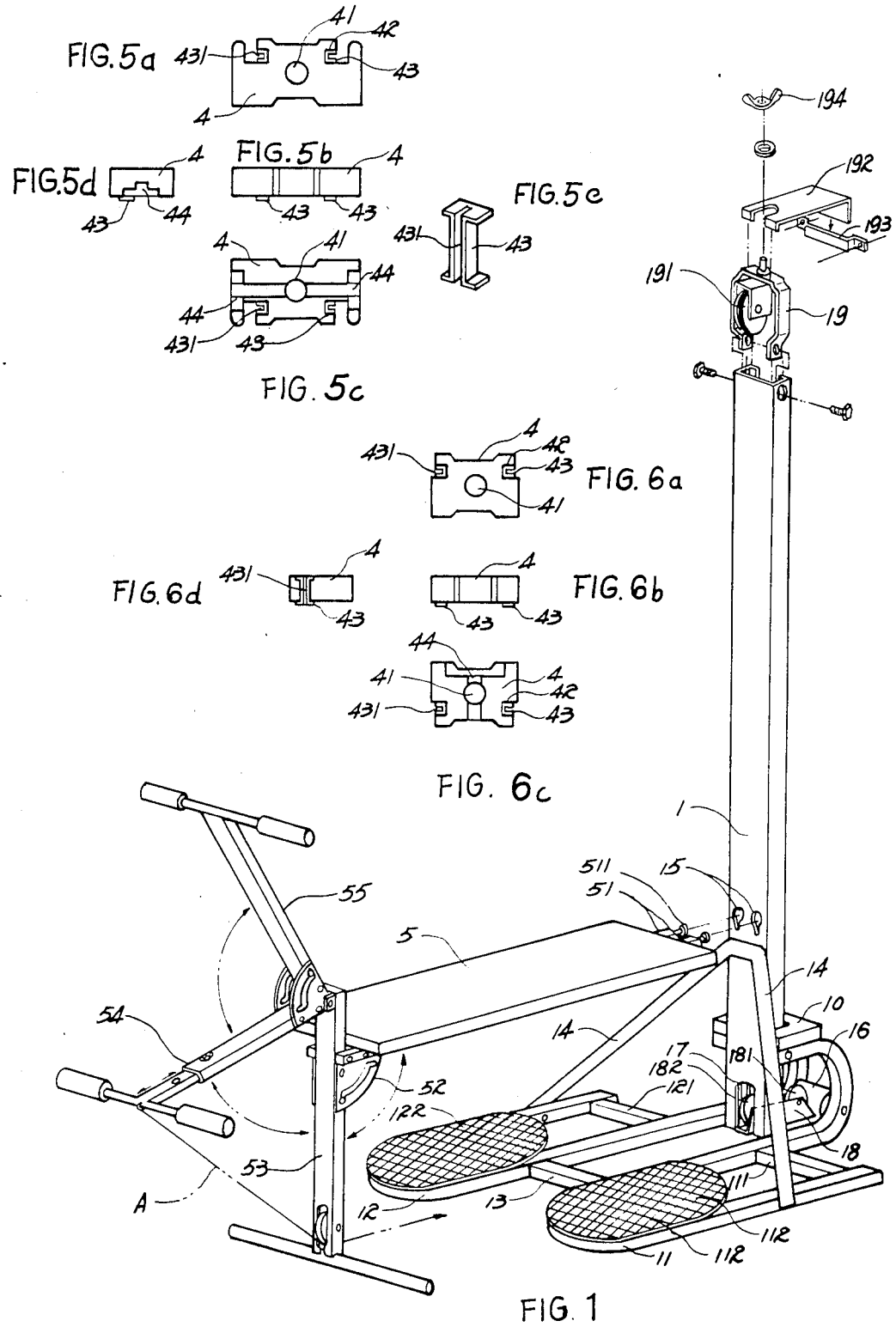
FIG. 1 is a partially exploded, perspective view of the gym set during assembly in one arrangement in accordance with this invention.
FIG. 5*a* is a top view of the weight block embodiment of FIG. 3.
FIG. 5*b* is a rear view of the weight block embodiment of FIG. 3.
FIG. 5*c* is a bottom view of the weight block embodiment of FIG. 3.
FIG. 5*d* is a side view of the weight block embodiment of FIG. 3.
FIG. 5*e* is an enlarged perspective view of a detail of the FIG. 3 embodiment.
FIG. 6*a* is a top view of the weight block embodiment of FIG. 4.
FIG. 6*b* is a rear view of the weight block embodiment of FIG. 4.
FIG. 6*c* is a bottom view of the weight block embodiment of FIG. 4.
FIG. 6*d* is a side view of the weight block embodiment of FIG. 4.

Now this invention will be described as follows with reference to the drawings.

This invention is a gym set which comprises, as a main frame, a channel-shaped, upright hollow post 1 having a rectangular cross-section with a rear opening, the post 1 being screwed by bolts at both sides of its lower end to two bent support pipes 11,12 which can be placed on the ground. A rubber shock absorber 10 is set on the spot where said bent support pipes 11,12 are screwed together with said post 1 so as to prevent weight blocks from transmitting shocks to the pipes 11,12 when dropping down on said absorber 10. Between said bent pipes 11,12, a cross bar 13 is fixed to connect both pipes 11,12 in order to keep a steady distance between them. Horizontal bars 111,121 are also fixed between two lying-on-the-ground sections of both said bent pipes. All the above-mentioned bars are used to support said post 1 solidly standing on the ground. Furthermore, a support rod 14 is screwed at its middle together with said post 1. The support rod 14 has two slanting-downward wings, the lower ends of which are respectively screwed to outer sides of said bent pipes 11,12 placed on the ground, in order to reinforce the upright standing of said post 1. In said post 1 a pair of parallel holes 15 are bored slightly above where said support rod 14 is connected with it so that a bench 5 can be combined with said post 1.

Behind the lower part of said post 1, a roller 16 set between both rear sections of said bent pipes 11,12 is used to move this gym set by rolling said roller 16 only if said gym set is tilted backward to keep said roller 16 touching the ground. Of course, unless said gym set is tilted backward, said roller 16 can not touch the ground.

Also, on the front section of said bent pipes 11,12 there are placed stepping plates 112,122 which are provided for an exerciser to stand on when the bench 5 is removed from this equipment.

At the lower end of said hollow post 1, there is a notch 17 at which a pulley bed 18 is located and at the front and rear of the bed, there are pulleys 181,182 around which a wire rope A lies. A reverse-U-shaped trestle 19 is screwed together with the top of said hollow post 1 and in said trestle 19 is set an eccentric pulley 191 around which said wire rope goes. Since the eccentric fixation of said pulley 191 is able to keep said wire rope A in such a position as it can not be disturbed by any other part, said pulley 191 can extend a little forward of said post 1 or a little backward thereof.

A reverse-U-shaped locking plate 192 and a U-shaped fixing plate 193 are used for steadying the top end of said post 1 against a wall. Said fixing plate 193 is to be nailed solidly to a wall, and then one perpendicular downward end of said locking plate 192 should be inserted in said fixing plate 193 between the latter and the wall; the other perpendicular downward end of said locking plate 192 is to be placed at the front edge of said trestle 19; then a butterfly nut 194 screws down said locking plate 192 on an upright threaded stud at the top of said trestle 19, and it means that the top end of said post 1 is fixed steady and immovable against the wall, which is important for this gym set to be safely used.

Figure 2:
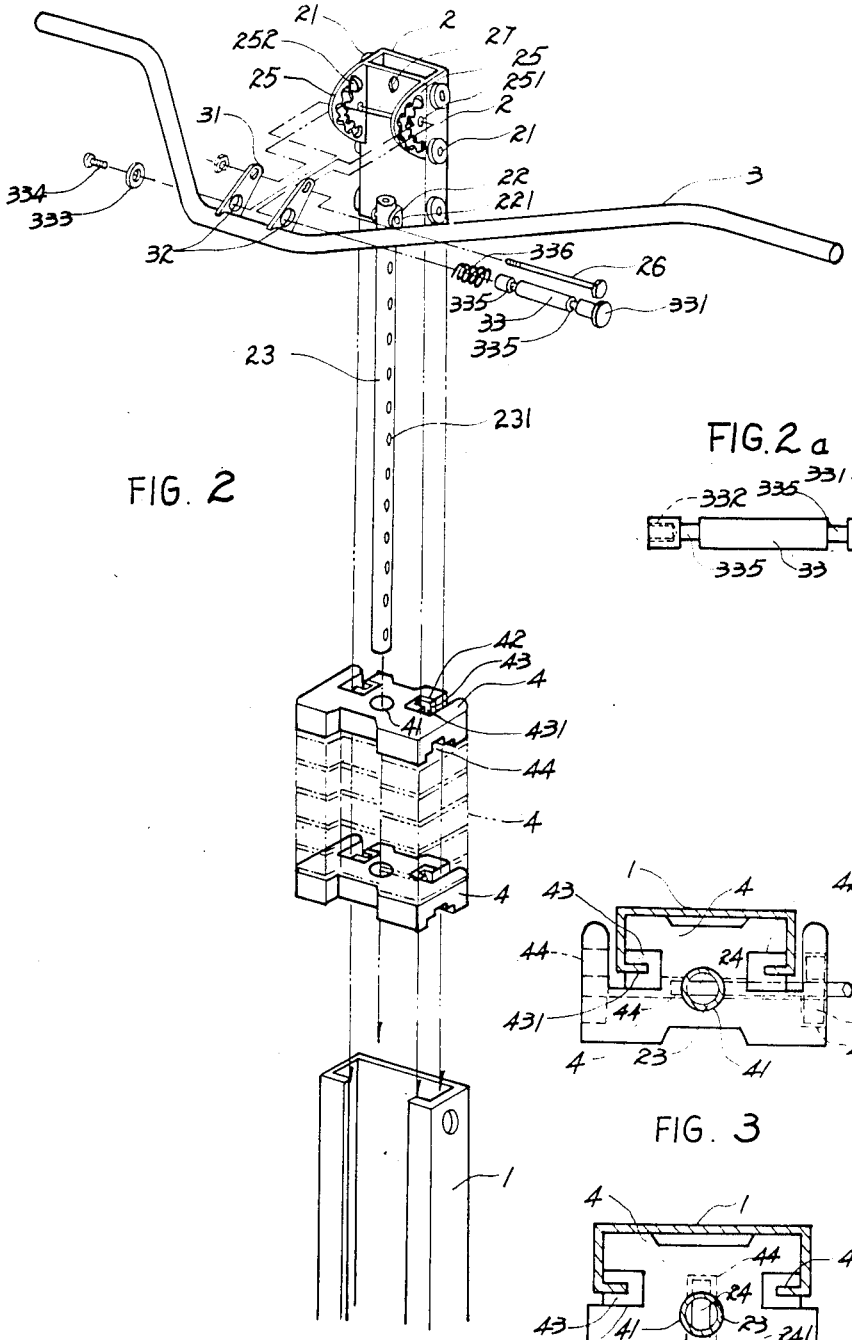
FIG. 2 is a partially exploded, assembly view of a weight bed assembly mounted in the gym set of FIG. 1.
Figure 2A:
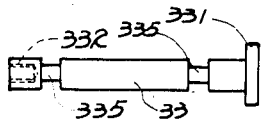
FIG. 2*a* is an enlarged view of a detail of FIG. 2.

The rear opening of said hollow post 1 extends longitudinally along the rear wall of the post. Within the post interior a weight bed 2 is to be installed in such a way as said weight bed 2 can go up and down along the inside of said hollow post 1. As FIG. 2 shows, said weight bed 2 includes a rectangular post with a hollow interior and equipped with three pulleys 21 respectively on each of two sides thereof serving for the whole assembly of said weight bed 2 to smoothly go up or down inside said post 1. At the lower rear side of said weight bed 2 are fixed two parallel fixing ears 22 with which a connecting rod 23 is combined together by means of a bolt 221; in said connecting rod 23 is horizontally bored a plurality of holes 231 along its body, which serves for inserting a T-shaped linking piece 24 of a weight block 4 whether in a right-left direction or in a front-rear direction. The inserting direction of said connecting rod 23 and said T-shaped linking piece 24 differs depending on the different shapes of weight blocks 4, and it will be described later.

Still, at both sides of the rear section of said weight bed 2, there is set respectively a semi-circular combining plate 25, at whose center a symmetrical circular hole 251 is bored so as to horizontally insert a fixing bolt 26 for connecting a handle 3 with said combining plates 25. Along the outer edge of said combining plates 25, there are bored respectively six symmetrical holes which constitute a guide rail 252 with 6 different angles which can supply said handle 3 with 6 choices of angle for acquiring different effects in exercise.

Said handle 3, as shown in FIG. 2, has two support arms 31 at its middle section. On each of said support arms 31 is bored a hole 32 and said arms 31 are to be bolted by a angle-change cylindrical bolt 33. The bolt 33 has one end made as a bolt head 331 and the other end as an inner tapped hole 332 able to be screwed in by a gasket 333 and a bolt 334. After having put said angle-change bolt 33 in place to fix up said handle 3 with said combining plates 25 of said weight bed 2, said handle 3 can be adjusted to any of the six different angles by moving said angle-change bolt 33 in one of the holes of said guide rail 252. Near each end of said angle-change bolt 33, is cut a reduced-diameter portion or concave ditch 335. A spring 336 is put around said angle-change bolt 33 to contact with said bolt head 331. When said spring 336 stays in its regular place, it always pushes said angle-change bolt 33 rightward keeping said two concave ditches 335 of said angle-change bolt 33 off said guide rail 252 of said combining plate 25 so that said handle 3 can be held steady at a certain definite angle. Pressing said angle-change bolt 33 leftwards compresses said spring 336, so that said concave ditch 335 are aligned with said guide rail 252 and free said angle-change bolt 33 for movement to any other hole in said guide rail 252. Then releasing said angle-change bolt 33 causes said spring 336 to push the bolt 33 rightwards, so that said concave ditches 335 are out of line with said guide rail 252 and consequently said handle 3 will become fixed again. Therefore, as mentioned above, said handle 3 is able to be fixed in one of six different angles as wanted.

Figure 3:
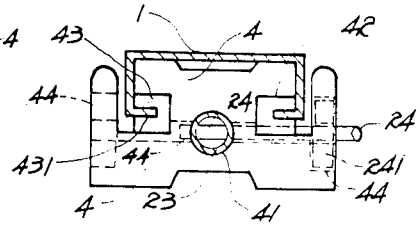
FIG. 3 is a cross-sectional view of one embodiment of a weight block.

Said weight block 4, as shown in FIG. 3, is provided through its center with a cylindrical hole through which said connecting rod 23 of said weight bed 2 is inserted. At the front edge of said weight block 4, two symmetrical notches 42 are cut and respectively covered with an I-shaped plastic cushion or spacer 43 which has a vertical cut 431 provided to lock with the two cut rear walls beside the rear opening of said hollow post 1. The upper surface of said plastic cushion 43 is on the same level as that of said weight block 4 and its bottom extends a little out of said weight block 4. Therefore, when a number of said weight blocks 4 are put up together, there is an equal gap between each of said blocks 4 in order that two side wings 241 of said T-shaped linking piece 24, after being inserted in, can support those said weight blocks 4 lying on it for moving up and down all together. In addition, in the bottom of said weight block 4, two T-shaped ditches 44 are cut respectively at each of its two sides in order that the main rod of said T-shaped linking piece 24 can be put through said hole 231 of said connecting rod 23 of said weight bed 2. (Here, said weight block 4 is so shaped as FIG. 2 shows, as has said T-shaped linking piece 24 set in horizontal sideward direction.)

Figure 4:
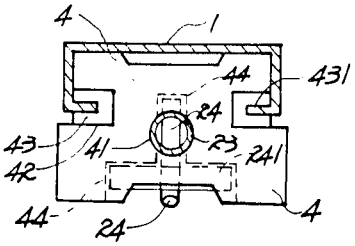
FIG. 4 is a cross-sectional view of another embodiment of a weight block.

Additionally, as shown in FIG. 4, another structure of said weight block 4 has said T-shaped linking piece 24 set in front-to-rear direction. A notch 42 is provided at each of two sides of said weight block 4, and I-shaped plastic cushions are placed therein; at the lower rear section of said weight block 4 is cut a T-shaped ditch 44, in which a T-shaped linking piece 24 is received. The structure of FIG. 4 enables said linking piece 24 to be hidden in unseen position behind the post 1. However, the different structures of the weight blocks mentioned above are both designed with safety in mind.

A bench 5, which is to be connected to said hollow post 1 by means of said holes 15 therein, has two fixed parallel poles 51; the front ends of said poles 51 are connected by triangular connectors 52 with a reverse-T-shaped leg 53; at the top end of said leg 53 is installed two T-shaped training handles 54,55 that can be placed at a right angle to each other or put together, while said handle 54 can be adjustable along its length; there are locking heads 511 at the rear ends of said two poles 51 that are inserted into said holes 15 of said post 1 with which said bench 5 is thus fixed. As for the detailed structure of said bench 5, it does not need to be described here, as it has been applied for a patent by the Taiwan application No. 7323309 by this same inventor.

Figures 10, 11:
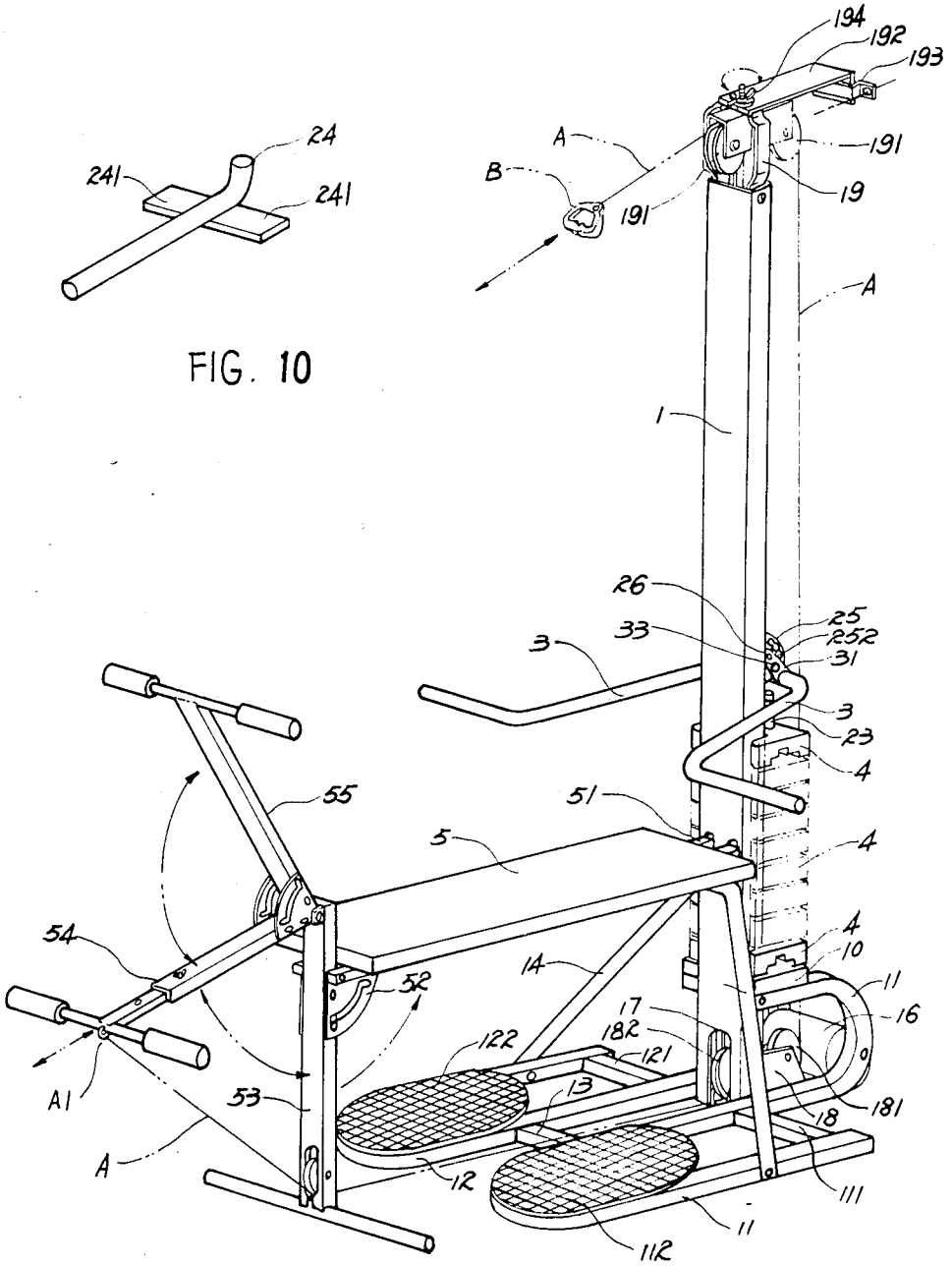
FIG. 10 is an enlarged, perspective view of a T-shaped linking piece.
FIG. 11 is an assembled view of the gym set of FIG. 1 in accordance with an additional arrangement of this invention.

Next, the use of this invention in the arrangement of FIG. 11 will be described. If it is used along with said bench 5, a connecting ring A1, at one end of a wire rope A, is hooked in a hooking hole 27 of said weight bed 2; then said rope A is trained around said pulley 191 which should be made to extend rearwardly out of said post 1, pulled down behind said post 1, and trained around said two pulleys 181,182, and finally another connecting ring A1, at the other end of said wire rope A, is hooked to said T-shaped training handle 54. Then pulling said T-shaped training handle 54 makes said weight blocks 4 go up or down through the pulling action of said wire rope A, and weight training can be attained. The purpose of said T-shaped linking piece 24 is to combine the needed number of said weight blocks 4 with said weight bed 2 by inserting said linking piece 24 in said holes 231 in said connecting rod 23 of said weight bed 2. It is quite simple to adjust the total weight chosen for training—only by the action of inserting in or pulling out said T-shaped linking piece 24.

Figure 7:
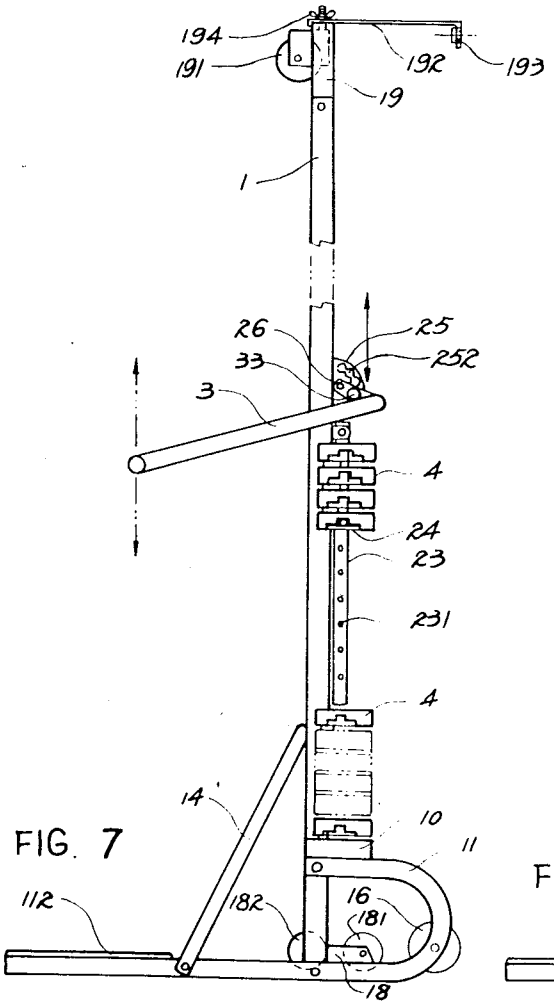
FIG. 7 is a side view of the gym set of FIG. 1 in another arrangement.

In case said bench 5 is not going to be used, pull said locking heads 511 at the end of said parallel poles 51 out of said holes 15 in said post 1, and said bench is ready to be put aside. Next, said rope A can also be detached; then the angle of said handle 3 can be adjusted again and fixed according to the body height and the angle required; the total weight needed can be selected by means of said T-shaped linking piece 24 which determines the needed number of said weight blocks 4, and the exerciser can perform weight lift training directly by pulling said handle 3. FIG. 7 shows this case.

Figure 8:
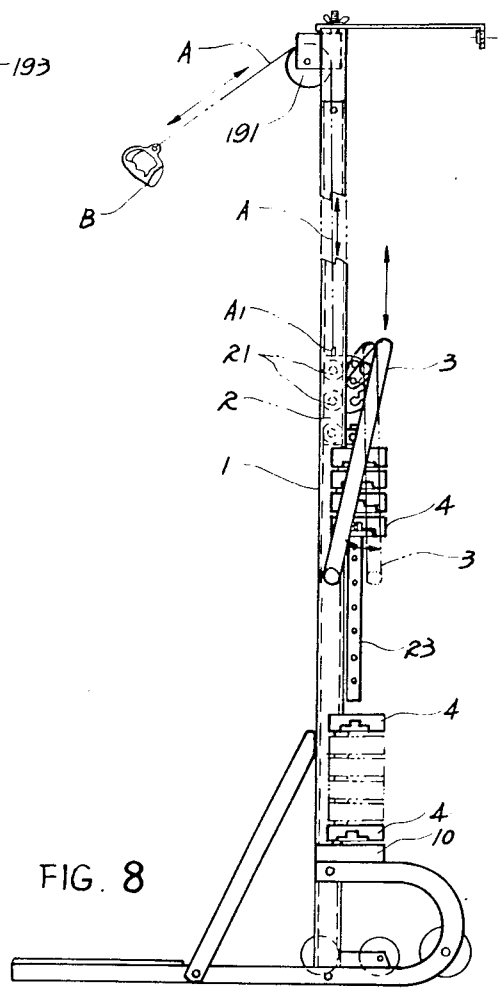
FIG. 8 is a side view of the gym set of FIG. 1 in still another arrangement.

In case said handle 3 is not to be used, change its location by adjusting it in the highest hole in said guide rail 252 of said combining plate 25 in said weight bed 2, push and leave it backward, hook one end of said wire rope A to said weight bed 2, train said wire rope A about said pulley 191 which should be made to extend forwardly in front of said post 1, and finally hook the other end of said wire rope A with a grip B. Now this arrangement is ready for taking weight-lift training by pulling down said grip B which makes said wire rope A lift up said weight blocks 4. FIG. 8 shows this case.

Figure 9:
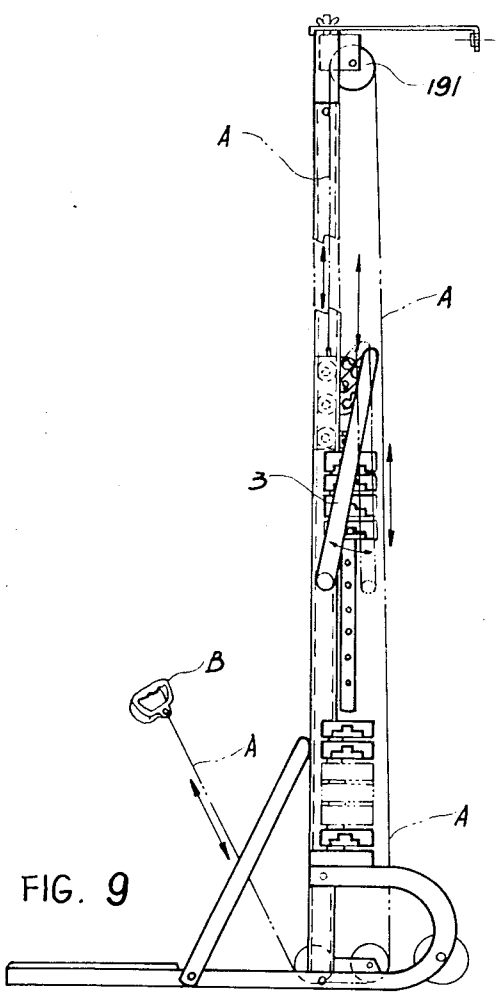
FIG. 9 is a side view of the gym set of FIG. 1 in yet another arrangement.

If the user wants to do pull-up training instead of pulling down, he trains said wire rope A around said pulley 191 which is positioned to extend rearwardly of the post 1, and trains said wire rope A around said pulleys 181,182 and guides said wire rope A through the notch 17 at the bottom end of said post 1, and finally hooks the end of said wire rope A with said grip B. Then this set is ready for pull-up training as shown in FIG. 9.

In general, this new gym set possesses special structures together with several training functions that can not be found in the conventional counterparts. Its structures are not only simple but also solid, with the weight blocks hidden behind and in the hollow post, making this gym set quite safe for use without any possibility of injury that may be caused by the moving-up-and-down weight blocks.

What is claimed is:

1. A gym set, comprising:

(a) a base mountable on a support surface;

(b) an upright column supported by the base, (i) said column having a planar front wall, a pair of planar side walls extending rearwardly and perpendicularly of the front wall, and a pair of planar rear walls extending toward each other in a plane generally parallel to, and spaced from, the front wall and terminating short of each other to form a rear opening which extends lengthwise along the column, (ii) said front, side and rear walls bounding an interior channel;

(c) a weight bed reciprocally movable lengthwise along the column, (i) said weight bed including a vertically-arranged stack of weight blocks, and means for selecting, at the option of an exerciser, the number of the weight blocks which will participate in the reciprocal movement of the weight bed, (ii) each weight block having a pair of cut-outs in which the rear walls are positioned, (iii) each weight block further having an interior block portion located within the channel, an exterior block portion located outside the channel, and an intermediate block portion between the interior and exterior block portions and extending through the rear opening, (iv) said blocks being located rearwardly of the front wall, and being reliably guided along the column, throughout the reciprocal movement; and (d) user-engaging means engageable by the exerciser, and operatively connected to the weight bed, for reciprocally moving the same along the column.

2. The gym set as recited in claim 1, wherein the base includes a pair of base plates on each side of, and located forwardly of, the column, and cross bars connected between the base plates to stabilize the same.

3. The gym set as recited in claim 1, wherein said base includes a roller located rearwardly of the column, said roller being adapted to rollably engage the support surface upon tilting of the gym set toward the support surface.

4. The gym set as recited in claim 1, wherein the weight blocks have apertures in vertical alignment with one another, and wherein the weight bed includes an elongated connecting post insertable through the aligned apertures, said connecting post having a plurality of mounting holes spaced along the length of the post, and wherein the selecting means includes a selecting element having a rod portion insertable below a selected number of weight blocks into a selected mounting hole.

5. The gym set as recited in claim 4, wherein each weight block has a T-shaped recess, and wherein the selecting element has a T-shaped configuration for reception in the T-shaped recess of a respective weight block.

6. The gym set as recited in claim 5, wherein each mounting hole extends in a horizontal direction between the side walls of the column, and wherein the rod portion is insertable along said horizontal direction through the recess of the respective weight block.

7. The gym set as recited in claim 5, wherein each mounting hole extends in a transverse direction between the front and rear walls of the column, and wherein the rod portion is insertable along said transverse direction through the recess of the respective weight block.

8. The gym set as recited in claim 1, wherein each weight block has a pair of spacers mounted thereon for spacing the respective weight block at a predetermined spacing relative to an adjacent weight block.

9. The gym set as recited in claim 8, wherein each pair of spacers is received in the cutouts of the respective weight block, and wherein each spacer has a slit in which a respective rear wall of the column is slidably received.

10. The gym set as recited in claim 4 wherein the weight bed includes a wheeled carriage connected to the connecting post, said wheeled carriage being mounted for movement within and along the channel of the column.

11. The gym set as recited in claim 1, wherein the weight bed includes a carriage mounted for movement within and along the column, said carriage having spaced-apart rear plates extending rearwardly through the rear opening, said rear plates having arcuate tracks composed of adjustment openings each having a circular cross-section, said adjustment openings being connected together by curved passages each having a predetermined cross-section smaller than each said respective circular cross-section; and wherein said user-engaging means includes a handle pivotably mounted to the carriage at a pivot axis located rearwardly of the column, and an adjustment assembly received in said arcuate tracks, and operative for changing the elevation and orientation of the handle relative to the support surface.

12. The gym set as recited in claim 11, wherein the adjustment assembly includes a cylindrical pin having a predetermined diameter, and a pair of reduced-diameter portions at either end of the pin, said predetermined diameter of the pin corresponding in size and fittable within a selected pair of circular adjustment openings, said reduced-diameter portions corresponding in size and fittable within a selected pair of curved passages; and wherein the adjustment assembly includes means for biasing the pin to a locked position in which the pin is received in a selected pair of adjustment openings, and means for displacing the pin from the locked position to an unlocked position in which the reduced-diameter portions are temporarily received in the selected pair of adjustment openings prior to moving the reduced-diameter portions along the curved passages to another selected pair of adjustment openings, whereupon release of the displacing means causes the biasing means to urge the pin to another locked position in which the pin is received in said other selected pair of adjustment openings.

13. The gym set as recited in claim 1; and further comprising a top pulley mounted at an upper end region of the column, and wherein the user-engaging means includes an elongated wire having one end connected to the weight bed, another end connected to a handgrip, and an intermediate wire portion entrained about the top pulley, whereby the exerciser can perform pull-down exercising movements.

14. The gym set as recited in claim 1, and further comprising a top and a bottom pulley mounted respectively at upper and lower regions of the column, and wherein the user-engaging means includes an elongated wire having one end connected to the weight bed, another end connected to a handgrip, and an intermediate wire portion entrained about the top and bottom pulleys, whereby the exerciser can perform pull-up exercising movements.

15. The gym set as recited in claim 1; and further comprising a bench detachably connected to the column, said bench having a horizontally-extending table extending forwardly of the column, a vertically-extending support leg at the front of the table, and a training bar assembly pivotably mounted to the bench; and further comprising a top and a bottom pulley mounted respectively at upper and lower regions of the column, and wherein the user-engaging means includes an elongated wire having one end connected to the weight bed, another end connected to the training bar assembly, and an intermediate wire portion entrained about the top and bottom pulleys, whereby the exerciser can perform exercising movements while being supported on the bench.

16. The gym set as recited in claim 15, wherein the training bar assembly includes a pair of training bars extending at right angles to each other, one of the training bars being mounted for telescoping movement on the bar assembly and being connected to said other end of the wire.

17. The gym set as recited in claim 1, and further comprising a top pulley mounted at an upper end region of the column, said top pulley extending forwardly of the front wall of the column.

18. The gym set as recited in claim 1; and a top pulley extending rearwardly of the front wall of the column.

19. The gym set as recited in claim 1; and further comprising support means for supportably mounting the column at a distance from a vertical wall behind the column, said support means including a generally U-shaped bracket fixedly mounted to the wall and bounding a space therewith, a distancing bracket having a flanged end insertable into said space, and an opposite end threadedly mounted to an upper portion of the column.

* * * * *